United States Patent [19]

Smith et al.

[11] Patent Number: 4,789,354

[45] Date of Patent: Dec. 6, 1988

[54] VOICE/DATA COMMUNICATION TERMINATION CONNECTOR

[75] Inventors: Philip M. Smith; Elmont E. Hollingsworth, both of Austin; Robert A. Wandmacher, Cedar Park; Thomas W. Rosckes, Georgetown, all of Tex.; Russell A. Roiko, Rogers; Dennis M. Cheesebrow, Roseville, both of Minn.

[73] Assignee: Minnesota Mining and Manufacturing Company, St. Paul, Minn.

[21] Appl. No.: 96,891

[22] Filed: Sep. 14, 1987

[51] Int. Cl.[4] ..... H01R 4/24

[52] U.S. Cl. ..... 439/395

[58] Field of Search ..... 439/391–425

[56] References Cited

U.S. PATENT DOCUMENTS

| | | | |
|---|---|---|---|
| 4,171,857 | 10/1979 | Forberg et al. | 339/97 P |
| 4,175,818 | 11/1979 | Kourimsky | 439/395 |
| 4,193,201 | 3/1980 | Van Horn | 439/395 |
| 4,283,103 | 8/1981 | Forberg et al. | 339/59 M |
| 4,527,852 | 7/1985 | Dechelette | 439/396 |
| 4,615,576 | 10/1986 | Gerke et al. | 339/97 P |

*Primary Examiner*—Joseph H. McGlynn

*Attorney, Agent, or Firm*—Donald M. Sell; John C. Barnes

[57] ABSTRACT

A connector for communication wire pairs has an insulating body formed with sinuous channels for capturing the insulated wire, U-slot contact elements for making contact with the wires and said contacts having spring elements formed by U-shaped cuts in the periphery of the element for contact with an external circuit to connect the same in series or parallel with said spliced wires.

20 Claims, 3 Drawing Sheets

35
34
31
39
29
30
27
26
25
12
16
15
17

34
25
35
26
4
28
27
31
50
60
41
40
45
44
49
62
54
53
35
34

VOICE/DATA COMMUNICATION TERMINATION CONNECTOR

BACKGROUND OF THE INVENTION

1. Field of the Invention

This invention relates to an improved termination connector for an incoming cable and distribution wires of a voice, data, or integrated voice/data communications system, and in one aspect to an improved structure affording ease in the use of the connector and for connecting conductors in a form such that the connector restricts inadvertent shorting of elements and it allows tests to be made easily on the conductors to test the operation of equipment such as a telephone to determine the source of any problems or where a break might occur in the line.

2. Description of the Prior Art

Termination and distribution connectors have been in use in the communications industry for a long time to afford rapid connection of distribution wires to a pair of wires of an incoming or outgoing cable. The systems are built for use with pairs of wires. Wire pairs are joined to at least one other pair to perfect the transmission. Also, it is very necessary that the splice between one pair and the other pair be readily accessible to disconnect, change or rearrange the connections.

Prior devices have been available to make such splices and to permit the rearrangement of the conductors. Examples of such prior art connectors include U.S. Pat. No. 4,171,857, showing a connector having an improved clamping element to secure a wire to a connector for connection by a setting tool. The connector of the present device is a substantial improvement over the connector of the '857 patent in that the body of the connector is provided with a 5-pair length, bluntly pointed members project from the body to define the areas for connecting pairs of wires, and strain relief channels are formed in the body to capture the unattached wires and to maintain the attached wire in place. The connector of the present invention also has improved contact elements which are received in the body of the connector from the bottom.

One form of contact element, formed of appropriate conductive resilient spring-type material, provides a current path that can be broken by separation of two spring contacts which are normally in contact between the pairs of U-slot spring reserve insulation piercing contacts. A second form maintains a current path between the U-slot spring reserve contacts but allows a test probe to be inserted between a pair of spring contacts. Contacts which perform the same function, i.e. parallel or series contact with a test probe, are illustrated in U.S. Pat. No. 4,283,103. The differences are not in functions but in the improved construction of the contact elements and their relationship to the connector support structure.

The blocks of the connector of the present invention permit the same to be formed in any number of elements on a frame.

It is the object of the present invention to provide devices according to this invention which have a contact affording a make-before-break contact feature which will permit the test probes to look both ways along the conductors from the contact. Secondly, the contact element will permit the test probe to be inserted into the line without interruption of the normal splice at the contact between the conductors.

A further feature of the present invention is to provide a cross-connect terminal connector for 10-pair, 20-pair 25-pair, or 50-pair of communication wires.

SUMMARY OF THE INVENTION

The present invention relates to an improved insulation piercing wire contact element having a spring contact formed by an inverted U-shaped cut between the parallel sides of the element. The contact elements are disposed in a cross-connect system for use with communications wiring comprising a body in which the contact elements are recessed to protect the contacts from exposure on the exposed face of the block, thus providing a quiet front such that three is restricted possibility of inadvertently shorting any of the pairs of wires by placing a tool against the front of the connector.

The connector body comprises a support structure having opposed aligned rows of wire receiving channels for 5 pairs of wires on one side and 5 pairs of wires on the other side and a central channel between said opposed rows of wire-receiving channels and extending transversely thereto. The central channel affords access to the contact elements for insertion of a test probe or other connector to contact wire pairs. The body also provides wire retaining members for retaining, unattached wires and a sinuous path for strain relief once the wires are attached to the contact elements.

The probe or other connector may be adapted to connect to the connected wire pairs in either parallel or series arrangement, depending on the selection of the contact element, and with respect to the series connected element, the same is designed such that there is a connection to the connector prior to a break in contact of the contact element between the conductors.

A frame or base supports an array of connector bodies to make up a 10-pair, 20-pair, 25-pair, or 50-pair crossconnect connector.

BRIEF DESCRIPTION OF THE DRAWINGS

The present invention will be further described with reference to the accompanying drawing wherein.

DETAILED DESCRIPTION

Figure 7:
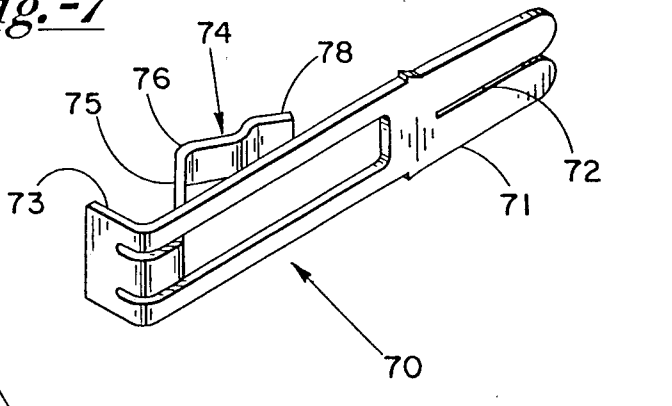
FIG. 7 is a perspective view of a contact element of the connector of FIG. 6.
Figure 1:
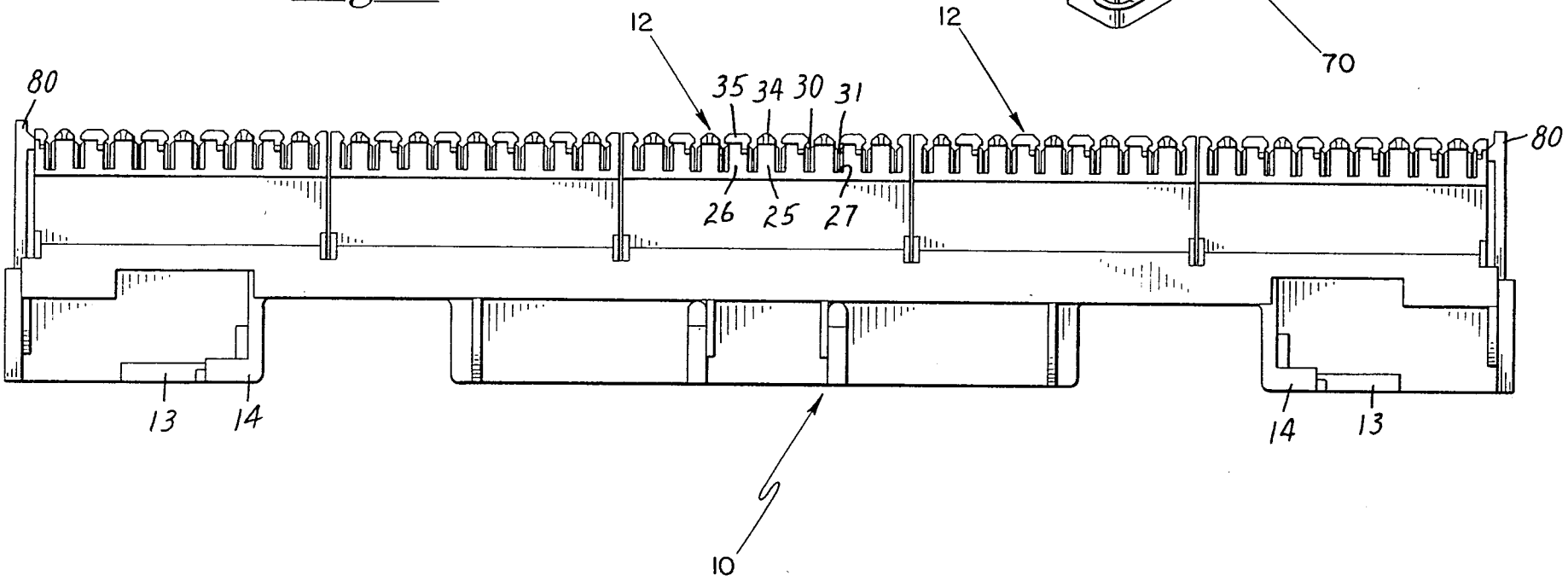
FIG. 1 is a side elevational view of a 50-pair connector constructed according to the present invention.

In the illustrated connector there is a base 10 adapted to fit on a bracket positioned in the distribution area of a building to handle the communication wires. This base 10 is adapted to support 10 connector blocks, each identified by the reference numeral 12, such that, as illustrated, the total connector can handle 50 pairs of circuits. Each connector block 12 is adapted to clamp onto the frame 10 and is therefore locked in place. As indicated in FIG. 2, each connector block 12, formed of an insulative material, is provided with a leg 15 adjacent each corner which depends from the lower surface 16 of each side of the connector block and is formed with a detent-receiving opening 17 which cooperates with a pall 19 formed in the inner surface of the side walls of the base 10, as shown in FIG. 4.

The base 10 is formed with four feet adjacent the corners which support a pair of shelves or rails 11 which support the blocks 12 and form the base thereof to retain the contact elements in place by raised pads. The feet are disposed beneath the rails 11 and comprise a plate 13 engageable by a pawl on a standard 89B or 89D bracket and approjecting hook shaped stop member 14 which engages the standard bracket to restrict linear movement of the frame 10 on the bracket.

Figure 2:
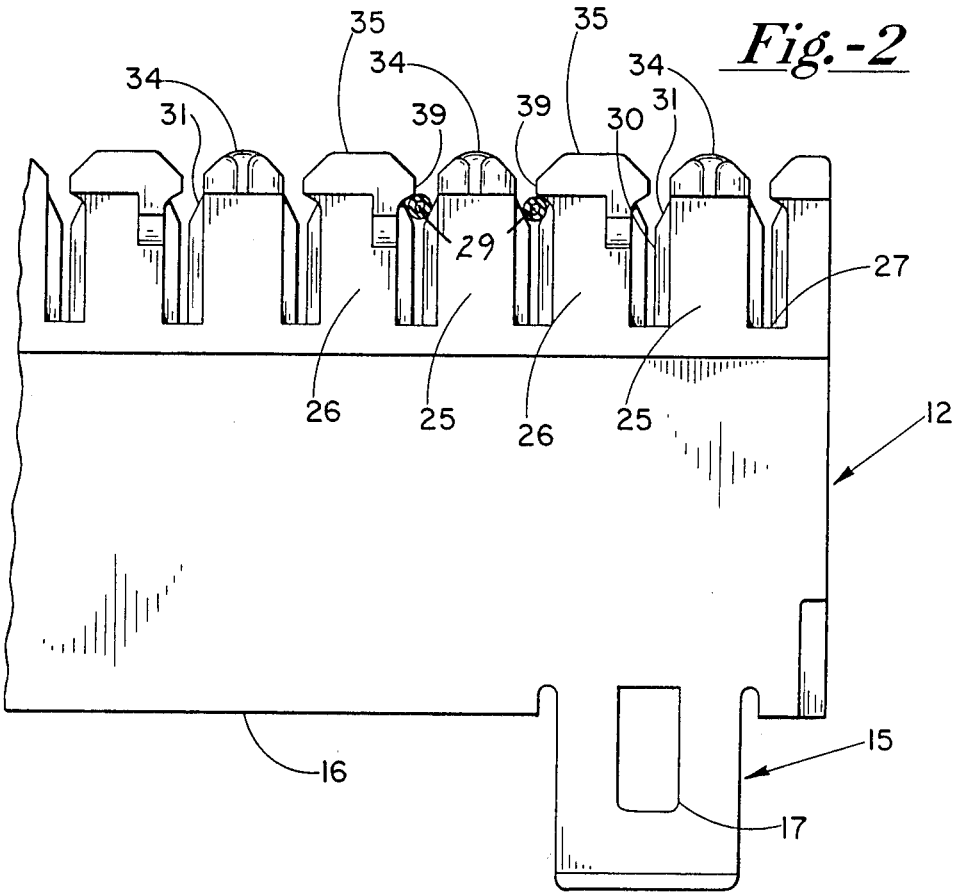
FIG. 2 is an enlarged fragmentary side elevational view of the connector of FIG. 1.
Figure 3:
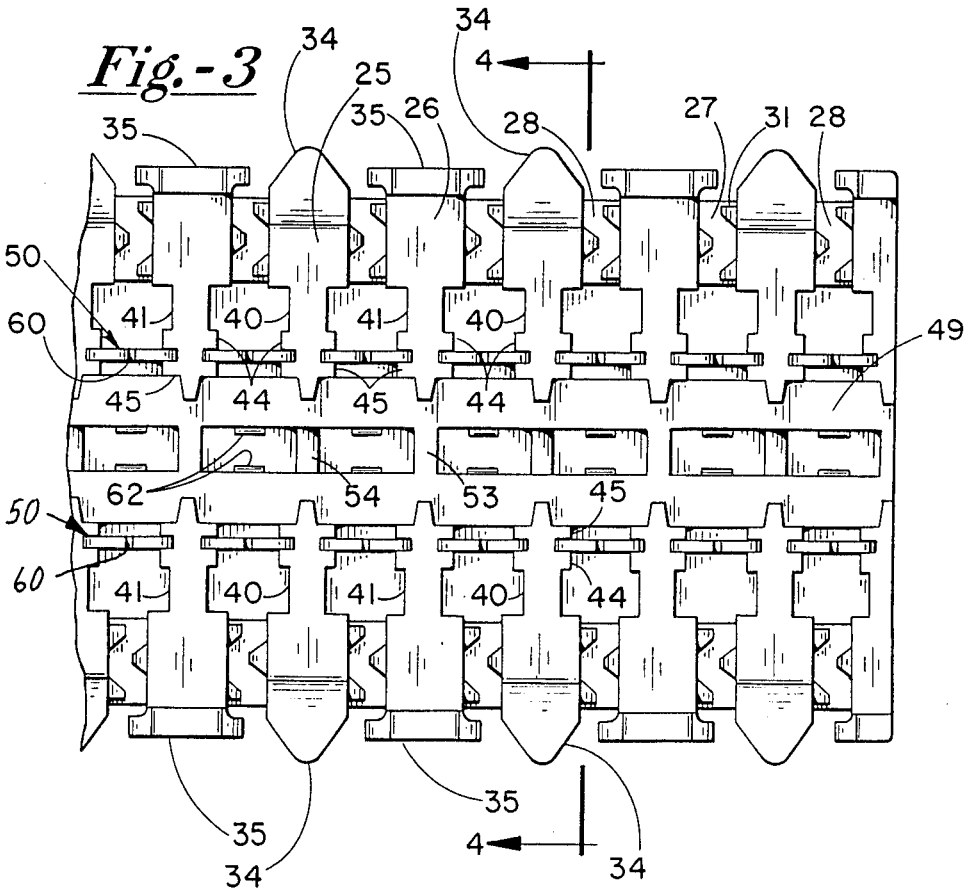
FIG. 3 is a fragmentary plan view of the connector of FIG. 1.
Figure 4:
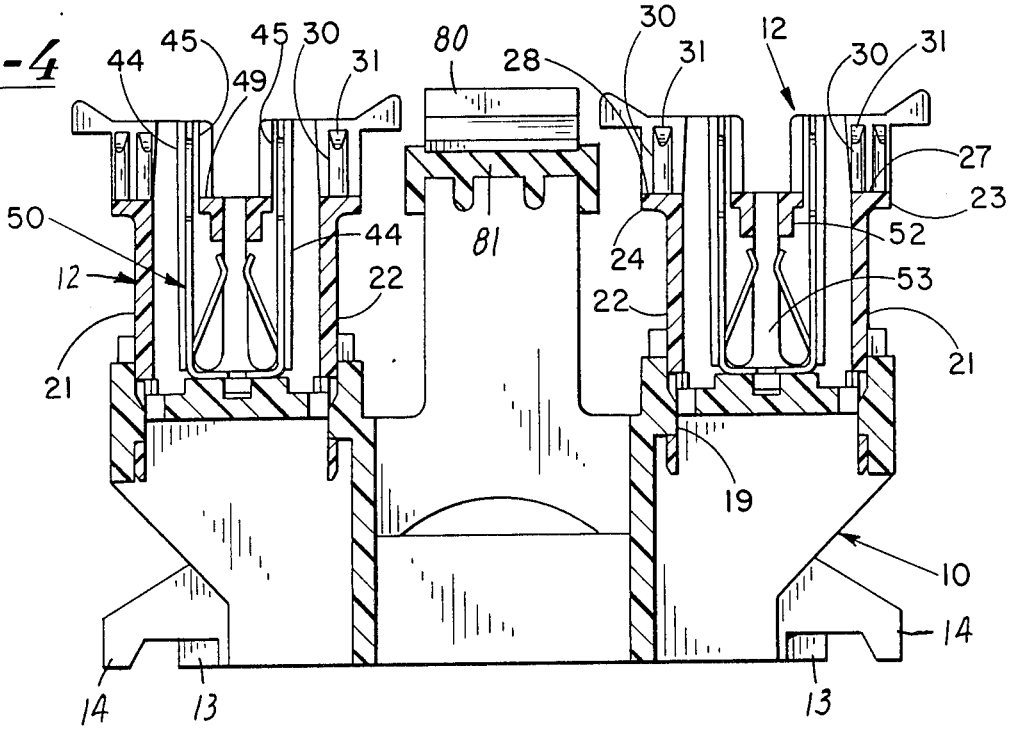
FIG. 4 is a transverse sectional view of the connector of FIG. 1 taken along the line 4—4 of FIG. 3.

Referring now to FIGS. 2, 3, and 4, the insulative body of a connector block 12 will be more fully described. The body is provided with a continuous outer side wall 21 and an inner side wall 22, both of which are provided with pairs of the legs 15 depending from the sides at their ends.

On the upper edge of the walls 21 and 22 is a flange 23 and 24 respectively, from which extend wall members 25 and 26 in an alternate fashion defining therebetween channels 27 and 28. Opposite sides of the wall members 25 and 26 are formed with fins 30 having a convex surface with a tapered end 31 distal from the flange 23 or 24 such that a pair of fins 30 on one member cooperate with a fin 30 on the other wall member to define a sinuous path in the direction of the respective channels 27 and 28 wherein the wire will be subjected to at least three bends, causing the same to resist movement in its lengthwise direction. The wall members 25 have outwardly projecting upper end portions 34 which are bluntly pointed to aid in separating pairs of wires to be inserted in the connector. Positioned on each side of the wall member 25 is one of the wall members 26.

Each wall member 26 has at its upper edge a projection 35 extending lengthwise transversely of the channels 27 and 28 to cover a portion of the top of the channel. The projection 35 is formed with tapered upper corners (see FIG. 2) to aid in directing the wires, see wire 29, into the channels 27 and 28. The overhang 39 on each end of the projections 35 of the walls 26 thus capture the wires as they are initially placed in the channels 27 or 28 such that the wire may be released while the installer picks up the setting tool to finally set the wire down into the contact element and sever the free end of the wire. The setting of the conductor or wire in each of the channels also drives the wire between the fins 30 to capture the insulating wire sheath and afford maximum strain relief against longitudinal movement. The walls 37 at the ends of the blocks are defined by walls corresponding to 26 but divided longitudinally. The body of the block 12 is molded of a suitable flame-retardant and non-conductive thermoplastic material. The critical function of the body, besides the support for the contact elements, is to provide a quiet front for isolation of the circuits and strain relief on the wires between the U-slot spring-reserve insulation piercing contacts and the outer walls of the block. The sinuous path defined in each of the channels 27 and 28 is chosen to sufficiently clamp the 24 or 22 AWG solid copper wires to afford good strain relief at the contact elements. The sinuous path affords strain relief for wires of more than one gauge.

The walls 25 and 26 extend inwardly from the edge of the channels 27 and 28 with thinner wall sections 40 and 41 respectively. The wall sections 40 and 41 are formed on opposite sides with spaced ribs 44 and 45 which define slots which receive the contact elements 50, which will hereinafter be described, but maintain the ends recessed from the surface of the block. The wall sections 40 and 41, projecting from each side of the block 12 terminate short of touching and define a recessed area extending transversely of the wall sections 40 and 41. The recessed area has a base surface 49 which is formed on a bar 52 extending lengthwise of the body of the block 12. The bar 52 has a plurality of slotted access openings which are defined by walls of the bar member 52 and vertically extending webs 53 and 54 which alternate along the length of the bar 52. The webs 53 come to a position flush with the surface 49 of the bar wherein the webs 54 are shorter to define a pair of openings between adjacent webs 53 for receipt of a test probe. The staggered webs restrict placement of the test probe such that it could cross wires of adjacent pairs of wires.

In the slots defined between the ribs 44 and 45 are positioned the U-slot contact portion of the contact elements 50.

Figure 5:
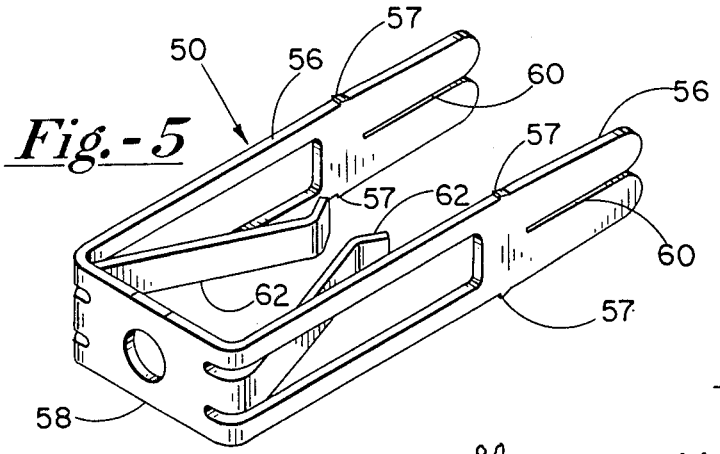
FIG. 5 is a perspective view of a contact element of the connector of FIG. 4.

Referring to FIG. 4, contact element 50 is illustrated in side elevation. The contact element 50 is illustrated in perspective in FIG. 5. The contact element is formed from a narrow elongate strip of conductive resilient metal which is die cut and stamped to form a U-shaped element which is symmetrical about both axes with two elongate legs 56 having generally parallel sides and small barbs 57 on opposite sides to secure the leg in the body. A slot 60 is formed in the upper end of each leg which extends from said upper end about one-third the length of the leg to define a U-slot contact element. The U-slot is adapted to receive one or two 24 or 22 AWG wires and pierce the insulating coating thereof and maintain spring reserve contact with the wire. It will accept two different sized wires with the smaller wire inserted first and afford spring reserve contact with the wires inserted therein. Below the bottom of the slot 60 in each leg 56 of the contact element 50 is an inverted U-shaped cut in the body of the leg 56 to form a wiping spring contact 62 from the leg 56.

The spring contact 62 is anchored in the bight portion 58 of the U-shaped element 50 and extends therefrom into the area between the legs 56 toward one another but spaced slightly to permit insertion therebetween of the end of a test probe. As shown in FIG. 4, the spring contacts 62 extend inwardly between the legs 56 of the U contact 50 such that they are positioned between a web 54 and a web 53 and generally centered with respect to one of the slotted openings in the bar 52 to be engageable with a test probe or other circuit element.

Figure 6:
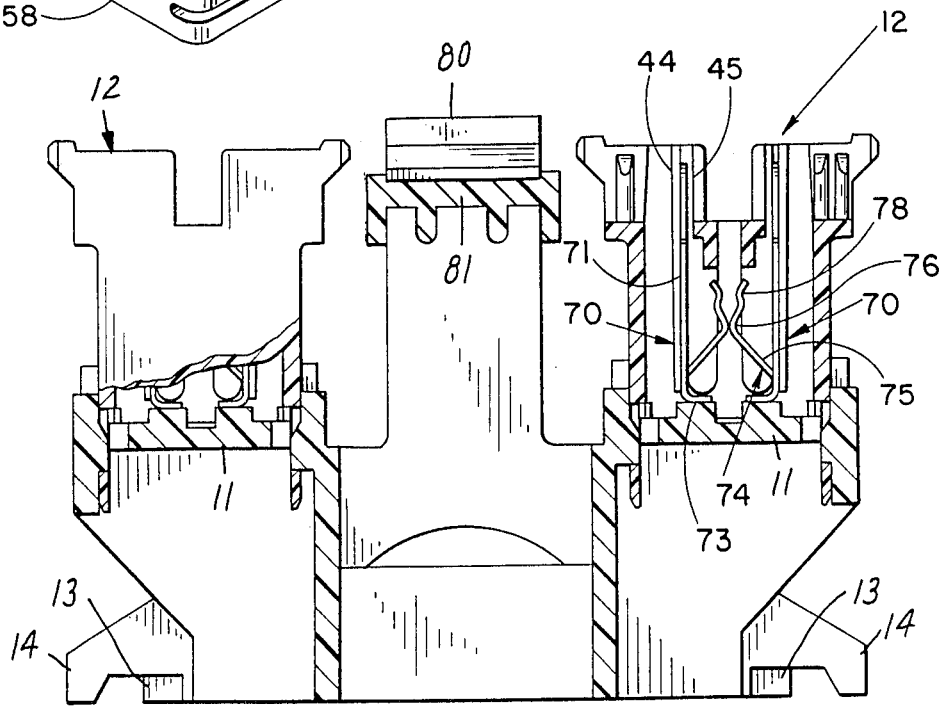
FIG. 6 is an end view, partially in section of an alternative embodiment of the connector of FIG. 1.

Referring now to FIG. 6 and to FIG. 7, there is shown an alternative embodiment of the connector. In this embodiment the block 12 remains the same, and reference numerals appearing thereon correspond to the reference numerals appearing in FIGS. 1 through 4. The difference is in the contact elements in each block 12. In this embodiment the elements on each side of the bar 52 are separate and are placed in opposed relation in the body of the block 12. Each contact element 70 has an elongate leg 71 with a slot 72 extending about one-third the length of the leg. The leg 71 is to be received in the slot between the ribs 44 and 45 and each define a U-slot spring-reserve insulation piercing contact member. The legs 71 have an angled foot 73 at the base thereof. The leg of the contact 70 is formed with an inverted U-shape cut in the leg 71 between the sides thereof to be symmetrical. The cut defines a spring contact 74 which may be bent from the plane of the element to a position where it is normally urged into contact with a similar contact 74 from the opposing contact element 70 in the block. As shown most clearly in FIG. 6, the spring contacts 74 are formed with converging portions 75 terminating at a bow 76 where the elements are normally in contact and then they diverge upwardly and converge toward the leg to end portions 78 which are spaced, affording receipt of a test tool between the ends of the contacts 74 prior to separation thereof at the bow 76 where they normally touch. Thus a pair of spring contacts are provided which will permit continuity of service throughout the steps of insertion and removal of the test probe if the test probe is appropriately wired. This type of contact element in the block 12 permits the test probe to look both ways from the spring contact to determine where there may be trouble on the line.

The base 10 is also provided with upstanding end posts 80, one at each end, for supporting a labelling strip 81 which extends parallel to the rails 11 between the blocks 12 making up a connector for the 50 pair of circuits.

Having thus described the invention with respect to the preferred embodiments thereof it is to be appreciated that changes may be made without departing from the scope of the invention as defined by the appended claims.

We claim:

1. A conductive metal contact element comprising an elongate strip having generally parallel sides and ends, a leg formed adjacent one end and said one end having a slot extending longitudinally of the strip to define a U-contact element to receive a wire therein, and said strip having an inverted U-shaped cut between said sides, said U-shaped cut forming a spring contact bendable from said strip and diverging from the plane of said strip and in the direction of said one end.

2. A conductive metal contact element comprising an elongate leg having generally parallel sides, said leg having a slot extending from one end thereof toward a base end, said slot extending about one-third of the length of said leg and being adapted to receive a wire therein, said leg having an inverted U-shaped cut between said sides and between said slot and said base end, said U-shaped cut forming a spring contact extending from said base end and diverging from said leg.

3. A contact element according to claim 2 wherein said base end is joined to the base end of a second similar elongate leg extending generally parallel to the first mentioned leg defining therewith a U-shaped contact element with said spring contact formed in each leg converging toward each other.

4. A contact element according to claim 3 wherein the bight portion joining the base end of said legs is generally perpendicular to said legs.

5. A contact element according to claim 4 wherein said U-shaped cut extends into said bight portion and said spring contact extends from said bight portion in a direction diverging from the adjacent leg.

6. A contact element according to claim 2 wherein said spring contact has a portion diverging from said leg, a second portion converging toward said leg to define a bow between said portions and second diverging and converging portions to the distal end thereof.

7. A contact element according to claim 2 wherein, a second similar contact element is positioned as a mirror image to said first mentioned contact element with said legs in contacting position affording a wire splice with a separable contact between said legs.

8. A connector for splicing pairs of communication wires comprising an insulating body having transversely spaced sides and ends, said sides having a flange formed at the top thereof and projecting spaced wall members on said flanges forming channels therebetween, the channels on one side being generally aligned with channels on the opposite side, fin means extending into said channels from the opposite wall members for forming a sinuous path in said channels and rib means for defining opposed slots extending perpendicular to said channels, and conductive metal contact elements each having an elongate U-shaped leg with generally parallel sides disposed in said opposed slots for positioning the slots of said U-shaped legs in the path of said channels.

9. A connector according to claim 8 wherein said U-shaped contact elements comprise an elongate leg having generally parallel sides, said leg having a slot extending from one end thereof toward a base end to define said U-shape, said slot extending about one-third of the length of said leg and being adapted to receive a wire therein, said leg having an inverted U-shaped cut between said sides and between said slot and said base end, said U-shaped cut forming a spring contact extending from said base end and diverging from said leg toward a central area between said sides.

10. A connector according to claim 9 wherein said base end of said contact element adjacent one side is joined to the base end of the U-shaped contact element adjacent with said spring contact of said contact elements in opposed relationship for receipt of an additional connector.

11. A connector according to claim 10 wherein said U-shaped cut in each contact extends into portion of said contact elements joining said elements and said spring contact extends from said bight portion in a direction diverging from the adjacent leg.

12. A connector according to claim 9 wherein said spring contact on one connector element has a portion diverging from said leg, a second portion converging toward said leg to define a bow between said portions and second diverging and converging portions to the distal end thereof, and said bow on the contact element adjacent one side contacts the bow adjacent the contact element adjacent the other side of said body.

13. A connector for splicing pairs of communication wires comprising an insulating body having transversely spaced sides and ends, each of said sides having a top surface and projecting spaced wall members on said surface forming channels therebetween perpendicular to the sides, the channels on one wall surface being generally aligned with channels on the opposite wall surface, fin means extending into said channels from the opposite wall members for forming a sinuous path in said channels said wall members comprising first wall members having bluntly pointed projections on the upper edges thereof extending transversely outwardly from said sides and second wall members positioned alternately of said first wall members along said sides, said second wall members having upwardly projecting members above said sides and said projecting members having ends extending transversely over a portion of said channels toward said first wall members for capturing a wire conductor between said wall members, rib means projecting from said wall members for defining opposed slots extending perpendicular to said channels opposite said projections, and conductive metal contact elements each having an elongate U-shaped leg with generally parallel sides disposed in said opposed slots for positioning the slots of said U-shaped legs in the path of said channels.

14. A connector according to claim 13 wherein said body has a recess extending longitudinally between said wall members and parallel to said sides, said recess having a base surface and said base surface having slots extending therethrough and aligned with the channels, said contact elements having spring contact means extending from said legs into said slots formed in said base surface for making connection with a device inserted in said slots.

15. A connector dependent on claim 8 wherein said body has a recess extending longitudinally between said wall members and parallel to said sides, said recess having a base surface and said base surface having slots extending therethrough and aligned with the channels, said contact elements having spring contact means extending from said legs into said slots formed in said base surface for making connection with a device inserted in said slots.

16. A connector according to claim 13 wherein said U-shaped contact elements comprise an elongate leg having generally parallel sides, said leg having a slot extending from one end thereof toward a base end to define said U-shape, said slot extending about one-third of the length of said leg and being adapted to receive a wire therein, said leg having an inverted U-shaped cut between said sides and between said slot and said base end, said U-shaped cut forming a spring contact extending from said base end and diverging from said leg toward a central area between said sides.

17. A connector according to claim 16 wherein said base end of said contact element adjacent one side is joined to the base end of the U-shaped contact element adjacent the other side with said spring contacts of said contact elements in opposed relationship for receipt of an additional connector.

18. A connector according to claim 17 wherein said U-shaped cut,,in each, contact extends into a bright portion of said contact elements formed by joining said elements and said spring contact extends from said bight portion in a direction diverging from the adjacent leg.

19. A connector according to claim 13 wherein said spring contact on one connector element has a portion diverging from said leg, a second portion converging toward said leg to define a bow between said portions and second diverging and converging portions to the distal end thereof, and said bow on the contact element adjacent one side contacts the bow adjacent the contact element adjacent the other side of said body.

20. A connector according to claim 13 wherein said body has an open bottom into which said contract elements are inserted to position the same in said opposed slots and wherein said wall members extend sufficiently above said top surface of said sides to project above said U-shaped legs of said contact elements to restrict contact between said contact elements and an object placed on said wall members.

* * * * *

UNITED STATES PATENT AND TRADEMARK OFFICE

CERTIFICATE OF CORRECTION

PATENT NO. : 4,789,354

DATED : December 6, 1988

INVENTOR(S) : Philip M. Smith; Elmont E. Hollingsworth, both of Austin, Tex.; et al.

It is certified that error appears in the above-identified patent and that said Letters Patent is hereby corrected as shown below:

Col. 2, line 16, "three" should read --there--.

Col. 2, line 28, delete "comma" after "retaining".

Col. 3, line 14, "approjecting" should read --a projecting--.

Col. 6, line 6, delete "comma" after "wherein".

Col. 8, line 20, delete "comma comma" after "cut".

Col. 8, line 20, "bright" should read --bight--.

Signed and Sealed this

First Day of August, 1989

*Attest:*

*Attesting Officer*

DONALD J. QUIGG

*Commissioner of Patents and Trademarks*